US008275288B2

(12) United States Patent
Takagi

(10) Patent No.: US 8,275,288 B2
(45) Date of Patent: Sep. 25, 2012

(54) IMAGE FORMING DEVICE CAPABLE OF IMPROVING PRECISION IN RELATIVE POSITIONING OF CONVEYING UNIT AND FIXING UNIT

(75) Inventor: Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 254 days.

(21) Appl. No.: 12/700,273

(22) Filed: Feb. 4, 2010

(65) Prior Publication Data

US 2010/0215399 A1 Aug. 26, 2010

(30) Foreign Application Priority Data

Feb. 25, 2009 (JP) ..... 2009-041886

(51) Int. Cl.
*G03G 15/08* (2006.01)

(52) U.S. Cl. ..... 399/121; 399/122; 399/303; 399/400

(58) Field of Classification Search ..... 399/107, 399/121, 122, 302, 303, 308, 312, 316, 320, 399/322, 328, 361, 397, 400
See application file for complete search history.

(56) References Cited

U.S. PATENT DOCUMENTS

| | | | | |
|---|---|---|---|---|
| 4,513,417 | A | 4/1985 | Lamb et al. | |
| 5,041,871 | A * | 8/1991 | Hata | 399/125 |
| 6,108,514 | A * | 8/2000 | Nakayama et al. | 399/400 |
| 6,785,492 | B2 | 8/2004 | Tanizaki et al. | |
| 7,783,226 | B2 | 8/2010 | Tomatsu | |
| 7,835,663 | B2 | 11/2010 | Tomatsu | |
| 2002/0131801 | A1 | 9/2002 | Tomatsu | |
| 2003/0068173 | A1 | 4/2003 | Tanizaki et al. | |
| 2007/0160382 | A1 | 7/2007 | Tomatsu | |
| 2008/0003015 | A1 * | 1/2008 | Tomatsu | 399/110 |
| 2008/0012771 | A1 * | 1/2008 | Watanabe | 343/700 MS |
| 2009/0304426 | A1 * | 12/2009 | Nakagaki | 399/400 |

FOREIGN PATENT DOCUMENTS

| | | |
|---|---|---|
| JP | 59-158155 | 10/1984 |
| JP | 01-020777 | 4/1989 |
| JP | 05-046039 | 2/1993 |
| JP | 9016007 A | 1/1997 |
| JP | 2001-114448 | 4/2001 |
| JP | 2002229296 A | 8/2002 |
| JP | 2002-278330 | 9/2002 |
| JP | 2002268301 A | 9/2002 |
| JP | 2003107826 A | 4/2003 |

(Continued)

OTHER PUBLICATIONS

Office Action for Japanese patent application No. 2009-041886 mailed Jun. 21, 2011.

(Continued)

*Primary Examiner* — Walter L Lindsay, Jr.
*Assistant Examiner* — Benjamin Schmitt
(74) *Attorney, Agent, or Firm* — Banner & Witcoff, Ltd.

(57) ABSTRACT

An image forming device includes a main body having a main frame, a plurality of photosensitive members, a conveying unit that conveys a recording medium onto which images are transferred from the photosensitive members, a fixing unit that fixes the images onto the recording medium, and an attaching member that attaches both the fixing unit and an end section of the conveying unit nearest the fixing unit to the main frame.

11 Claims, 9 Drawing Sheets

FOREIGN PATENT DOCUMENTS

| | | | |
|---|---|---|---|
| JP | 2003-140529 | * | 5/2003 |
| JP | 2003140529 | | 5/2003 |
| JP | 2004029419 | A | 1/2004 |
| JP | 2006064895 | A | 3/2006 |
| JP | 2006208597 | A | 8/2006 |
| JP | 2007140370 | A | 6/2007 |
| JP | 2007148142 | A | 6/2007 |
| JP | 2007178879 | A | 7/2007 |
| JP | 2007-225918 | | 9/2007 |
| JP | 2008009260 | A | 1/2008 |

OTHER PUBLICATIONS

Decision of Rejection for Japanese patent application No. 2009-041886 mailed Oct. 18, 2011.

Office Action for Japanese patent application No. 2009-041886 mailed Feb. 15, 2011.

Japanese Patent Application 2009-41886, Office Action dated May 22, 2012.

* cited by examiner

IMAGE FORMING DEVICE CAPABLE OF IMPROVING PRECISION IN RELATIVE POSITIONING OF CONVEYING UNIT AND FIXING UNIT

CROSS REFERENCE TO RELATED APPLICATION

This application claims priority from Japanese Patent Application No. 2009-041886 filed Feb. 25, 2009. The entire content of this priority application is incorporated herein by reference.

TECHNICAL FIELD

The present invention relates to an image forming device, such as a laser printer.

BACKGROUND

There has been known a direct tandem type laser printer capable of forming color images. This type of laser printer includes a plurality of process cartridges arranged in a substantially horizontal direction, a conveying unit disposed below the process cartridges, and a fixing unit, all accommodated in a main casing having a main frame.

Each of the process cartridges includes a photosensitive drum on which a toner image is formed. The conveying unit includes a drive roller, a support roller, and an endless belt wound on the drive roller and the support roller. The toner image formed on each photosensitive drum is transferred onto a recording paper supported on the belt as the recording paper is conveyed by the rotation of the belt.

The fixing unit is disposed on a downstream side of the conveying unit in a paper conveying direction. The fixing unit includes a heat roller, a pressure roller pressing against the heat roller, and a guide member. The recording paper conveyed by the conveying unit is guided by the guide member to a nip point between the heat roller and the pressure roller, and the toner image transferred on the recording paper is fixed onto the recording paper as the recording paper passes through the nip point.

SUMMARY

It is an object of the present invention to provide an image-forming device capable of improving the precision in fixing the relative positions of a conveying unit and a fixing unit and the relative positions of the conveying unit and a guide member provided between the conveying unit and the fixing unit.

In order to attain the above and other objects, the present invention provides an image forming device including a main frame, a plurality of photosensitive members, a conveying unit, a fixing unit, and an attaching member. The main body has a main frame, and the plurality of photosensitive members are arrayed in the main body. The conveying unit is disposed in the main body so as to confront the plurality of photosensitive members. The conveying unit conveys a recording medium with images transferred from the photosensitive members. The fixing unit is disposed in the main body, and receives the recording medium conveyed by the conveying unit, and fixes the images onto the recording medium. The attaching member attaches both the fixing unit and an end section of the conveying unit nearest the fixing unit to the main frame.

According to another aspect, the present invention provides an image forming device including a main body, a plurality of photosensitive members, a conveying unit, a fixing unit, a first guide, and an attaching member. The main body has a main frame, and the plurality of photosensitive members are arrayed in the main body. The conveying unit is disposed in the main body so as to confront the plurality of photosensitive members. The conveying unit conveys a recording medium with images transferred from the photosensitive members. The fixing unit is disposed in the main body, receives the recording medium conveyed by the conveying unit, and fixes the images onto the recording medium. The first guide is disposed between the conveying unit and the fixing unit, and guides the recording medium from the conveying unit toward the fixing unit. The attaching member attaches both the first guide and an end section of the conveying unit nearest the fixing unit to the main frame.

BRIEF DESCRIPTION OF THE DRAWINGS

The particular features and advantages of the invention as well as other objects will become apparent from the following description taken in connection with the accompanying drawings, in which.

DETAILED DESCRIPTION

An image forming device according to an embodiment of the invention will be described while referring to the accompanying drawings. The present embodiment pertains to a laser printer 1 shown in FIG. 1.

The terms "upward," "downward," "upper," "lower," "above," "below," "beneath," "right," "left," "front," "rear" and the like will be used throughout the description assuming that the printer 1 is disposed in an orientation in which it is intended to be used.

Figure 1:
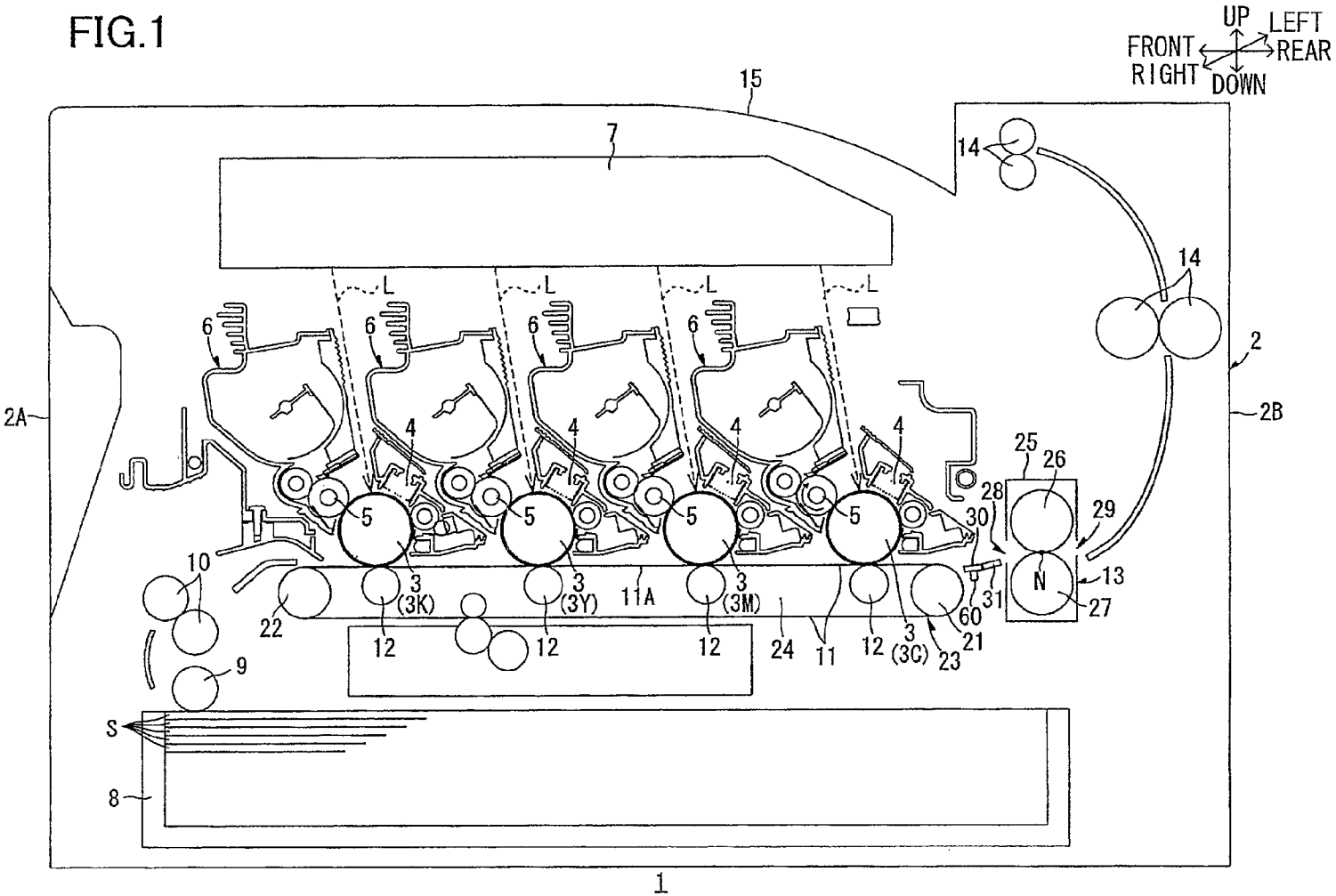
FIG. 1 is an illustrative cross-sectional right-side view of a printer according to an embodiment of the present invention.

The printer 1 is a direct tandem type color printer and, as shown in FIG. 1, includes a main casing 2 that is substantially box-shaped and elongated in a front-to-rear direction. The main casing 2 has a front wall 2A and a rear wall 2B.

Four photosensitive drums 3 are rotatably disposed inside the main casing 2. The photosensitive drums 3 are arranged parallel to each other, with their axes extending in a width direction (left-to-right direction) and are juxtaposed in the front-to-rear direction. The main casing 2 also accommodates four developer cartridges 6, four Scorotron chargers 4, and a scanning unit 7.

Each developer cartridge 6 supports a developing roller 5. The developing roller 5 is positioned adjacent to the photosensitive drum 3 and confronts the top thereof. The developer cartridges 6 are detachably mounted in the main casing 2. Each developer cartridge 6 accommodates toner that is supplied to and carried on the outer surface of the respective developing roller 5. Each Scorotron charger 4 is disposed in confrontation with the corresponding photosensitive drum 3. The scanning unit 7 is disposed in the top section of the main casing 2.

During image forming operations, each of the Scorotron chargers 4 uniformly charges the outer peripheral surface of the corresponding photosensitive drum 3. Then, the outer peripheral surface of the photosensitive drum 3 is exposed by a laser beam L emitted from the scanning unit 7. As a result, an electrostatic latent image corresponding to image data is formed on the outer peripheral surface of each photosensitive drum 3. Subsequently, the toner carried on the developing roller 5 is selectively supplied to the electrostatic latent image on the photosensitive drum 3. As a result, the electrostatic latent image is transformed into a visible toner image. In this manner, the toner image is formed on the photosensitive drum 3.

Each of the developer cartridges 6 accommodates toner of a different color. In this embodiment, the colors of toner accommodated in the developer cartridges 6 are black, yellow, magenta, and cyan. Accordingly, the color of the toner images formed on each photosensitive drum 3 also differs according to the photosensitive drum 3. In the following description, the four photosensitive drums 3 will be differentiated based on the color of the toner image formed thereon. Specifically, the photosensitive drums 3 include a black photosensitive drum 3K, a yellow photosensitive drum 3Y, a magenta photosensitive drum 3M, and a cyan photosensitive drum 3C arranged in this order from front to rear.

The printer 1 also includes, within the main casing 2, a sheet-supply cassette 8, a sheet-supply roller 9, a pair of registration rollers 10, a sheet-conveying unit 23, and a fixing unit 13. The sheet-conveying unit 23 includes a conveying belt 11, a drive roller 21, a follow roller 22, four transfer rollers 12, and a belt frame 24.

The sheet-supply cassette 8 is disposed in a bottom section of the main casing 2 and accommodates stacked sheets S of paper. The sheets S accommodated in the sheet-supply cassette 8 have a long dimension aligned with the front-to-rear direction and a short dimension aligned with the width direction.

During image-forming operations, the sheet-supply roller 9 disposed above the front edge of the sheet supply cassette 8 feeds the topmost sheet S accommodated in the sheet supply cassette 8 forward. The path along which the sheet S is fed is such that the sheet S is conveyed upward while being reversed from a forward direction to a rearward direction.

When fed upward, the leading edge of the sheet S is interposed between the pair of registration rollers 10. At a prescribed timing, the registration rollers 10 continue to convey the sheet S rearward onto the conveying belt 11.

The conveying belt 11 is an endless belt formed of a resin material and is wider than the sheet S. The conveying belt 11 is mounted over the drive roller 21 and the follow roller 22 and pulled taut with a prescribed force. The drive roller 21 and the follow roller 22 are arranged parallel to each other and are separated in the front-to-rear direction.

Center axes of the drive roller 21 and the follow roller 22 extend in the width direction. The drive roller 21 is disposed on the rear side of the photosensitive drum 3C, and the follow roller 22 is disposed on the front side of the photosensitive drum 3K.

When viewed along the width direction, the conveying belt 11 has a circular shape, elongated in the front-to-rear direction and flattened on the top and bottom. The portion of the conveying belt 11 running between the top of the drive roller 21 and the top of the follow roller 22 will be referred to as an upper portion 11A of the conveying belt 11. The top surface of the upper portion 11A is substantially horizontal. The four photosensitive drums 3 described above contact the top surface of the upper portion 11A of the conveying belt 11.

The four transfer rollers 12 are positioned inside the conveying belt 11, i.e., in the area between the drive roller 21 and the follow roller 22. The transfer rollers 12 are arranged parallel to each other and juxtaposed in the front-to-rear direction. Each transfer roller 12 confronts the bottom surface of the corresponding photosensitive drum 3, with the upper portion 11A of the conveying belt 11 interposed therebetween. Each of the transfer rollers 12 is applied with a transfer bias.

The belt frame 24 rotatably supports the drive roller 21, the follow roller 22, and the transfer rollers 12. The sheet-conveying unit 23 can be mounted in and removed from the main casing 2 through the front side thereof by displacing the front wall 2A of the main casing 2, for example, to expose the interior of the main casing 2.

As described above, the registration rollers 10 convey a sheet S to the conveying belt 11 and transfer the sheet S onto the surface of the upper portion 11A. The conveying belt 11 is driven to circulate clockwise in FIG. 1 by the rotation of the drive roller 21. Accordingly, a sheet S transferred onto the upper portion 11A is conveyed rearward.

At this time, toner images carried on the surfaces of the photosensitive drums 3 are transferred onto the top surface of the sheet S being conveyed on the top surface of the upper portion 11A by the transfer bias applied to the corresponding transfer rollers 12. The sequentially transferred images are superimposed over each other. Since the toner images carried on the photosensitive drums 3 are each of a different color, as described above, the toner images of the four colors form a color image when superimposed on the sheet S.

As the four toner images (color image) are transferred onto the sheet S from the four photosensitive drums 3, the conveying belt 11 continues to convey the sheet S rearward toward the fixing unit 13 disposed on the rear side of the sheet-conveying unit 23.

The fixing unit 13 can be mounted in and removed from the main casing 2 through the rear side thereof by displacing the rear wall 2B of the main casing 2, for example, to expose the interior of the main casing 2.

Figure 2:
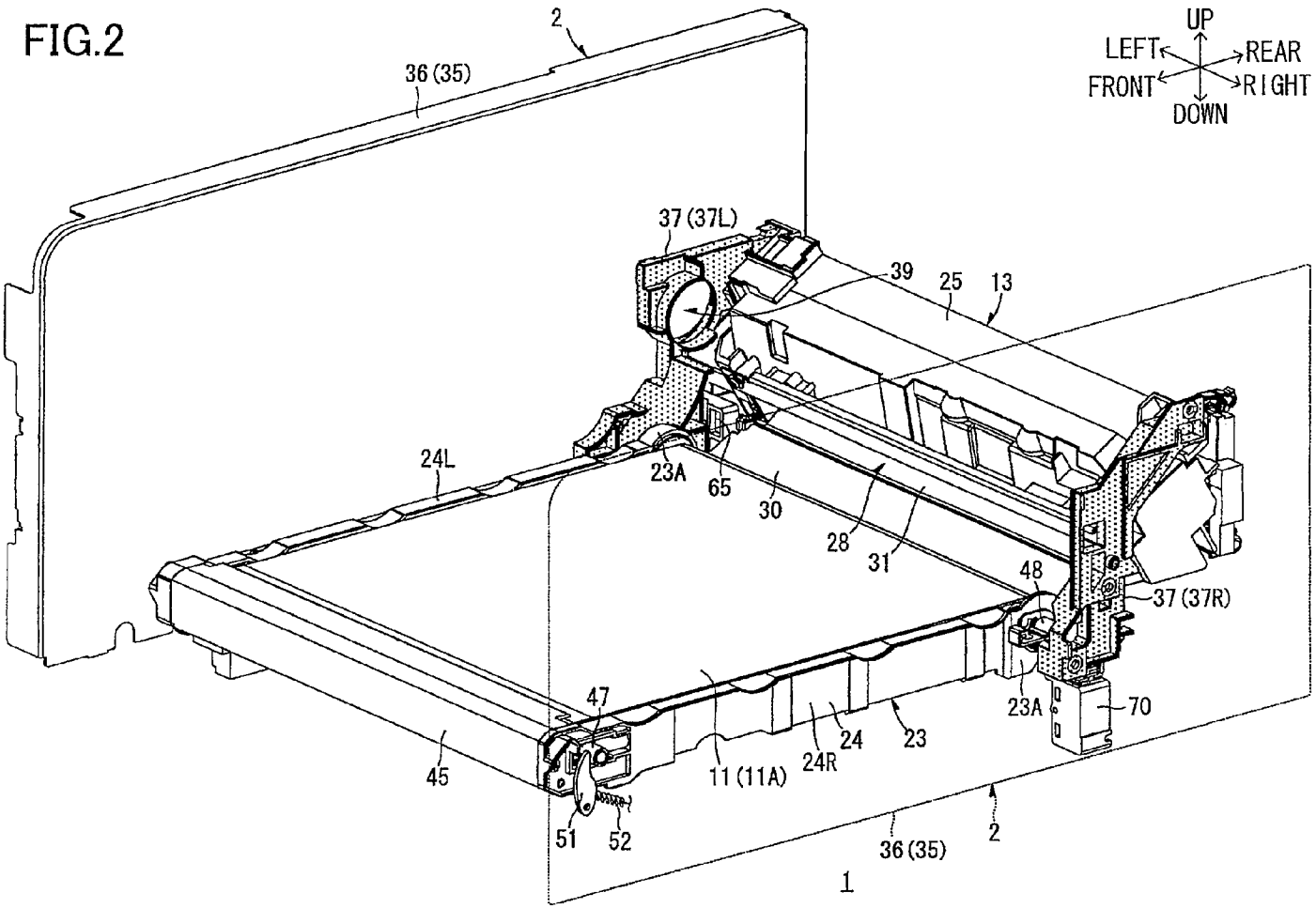
FIG. 2 is a perspective view of main components accommodated in a main casing of the printer from a point diagonally rightward and frontward thereof.

The fixing unit 13 includes a fixing casing 25, a heat roller 26, and a pressure roller 27. The fixing casing 25 is in a hollow box shape elongated in the width direction as shown in FIG. 2. The fixing casing 25 has a front surface formed with an inlet 28 and a rear surface formed with an outlet 29. Both the inlet 28 and the outlet 29 are in fluid communication with the interior of the fixing casing 25, and are elongated in the width direction to have an enough width to let the sheet S pass therethrough.

The heat roller 26 and the pressure roller 27 are disposed in the fixing casing 25 so as to be rotatable about respective center axes extending in the width direction. The peripheral surface of the heat roller 26 is covered with a fluorine resin, for example. The heat roller 26 also has a built-in halogen lamp (not shown) for heating the peripheral surface of the heat roller 26.

The peripheral surface of the pressure roller 27 is covered with a silicon rubber, for example. The pressure roller 27 presses against the bottom of the heat roller 26. The area of contact between the heat roller 26 and the pressure roller 27, referred to as a "nip position N" herein, is positioned rearward of the inlet 28 and forward of the outlet 29.

The sheet S conveyed to the fixing unit 13 enters the fixing casing 25 through the inlet 28 and passes rearward through the nip position N between the heat roller 26 and the pressure roller 27.

When the sheet S passes through the nip position N, the pressure roller 27 presses the upper surface of the sheet S transferred with the toner image onto the heated outer peripheral surface of the heat roller 26. As a result, the toner image is thermally fixed onto the upper surface of the sheet S.

Then, the sheet S is discharged out of the fixing casing 25 through the outlet 29. Subsequently, the sheet S is conveyed by pairs of conveying rollers 14 disposed downstream of the fixing unit 13 along a sheet-conveying path. The conveying rollers 14 convey the sheet S along a path that guides the sheet S upward while changing from a rearward direction to a forward direction, and discharge the sheet S onto a discharge tray 15 provided on top of the main casing 2.

Figure 8:
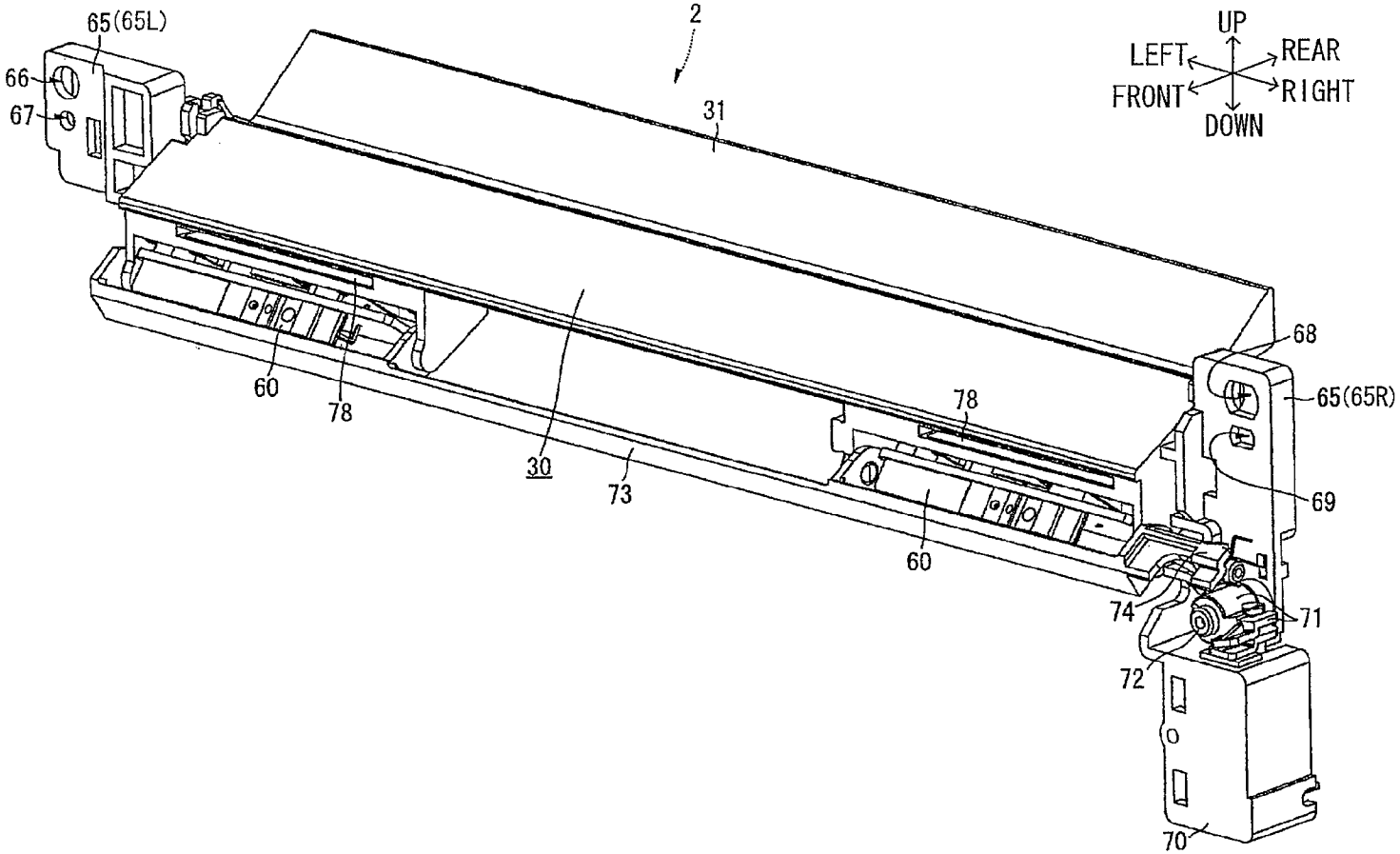
FIG. 8 is a perspective view of a first guide member of the printer from a point diagonally rightward and frontward thereof.

The printer 1 further includes a first guide part 30 and a second guide part 31 within the main casing 2 at a position between the sheet-conveying unit 23 and the fixing unit 13. As shown in FIG. 8, the first guide part 30 is rectangular in shape and elongated in the width direction. The dimension of the first guide part 30 in the width direction is greater than the width of the sheet S.

More specifically, as shown in FIG. 1, the first guide part 30 is disposed at a position between the sheet-conveying unit 23 and the fixing unit 13 and is slightly biased toward the sheet-conveying unit 23 side (i.e., forward, or upstream in the sheet-conveying direction). The first guide part 30 is positioned to the rear of and adjacent to the rear end of the upper portion 11A of the conveying belt 11. The first guide part 30 extends diagonally upward and rearward toward the inlet 28 of the fixing casing 25.

Figure 9:
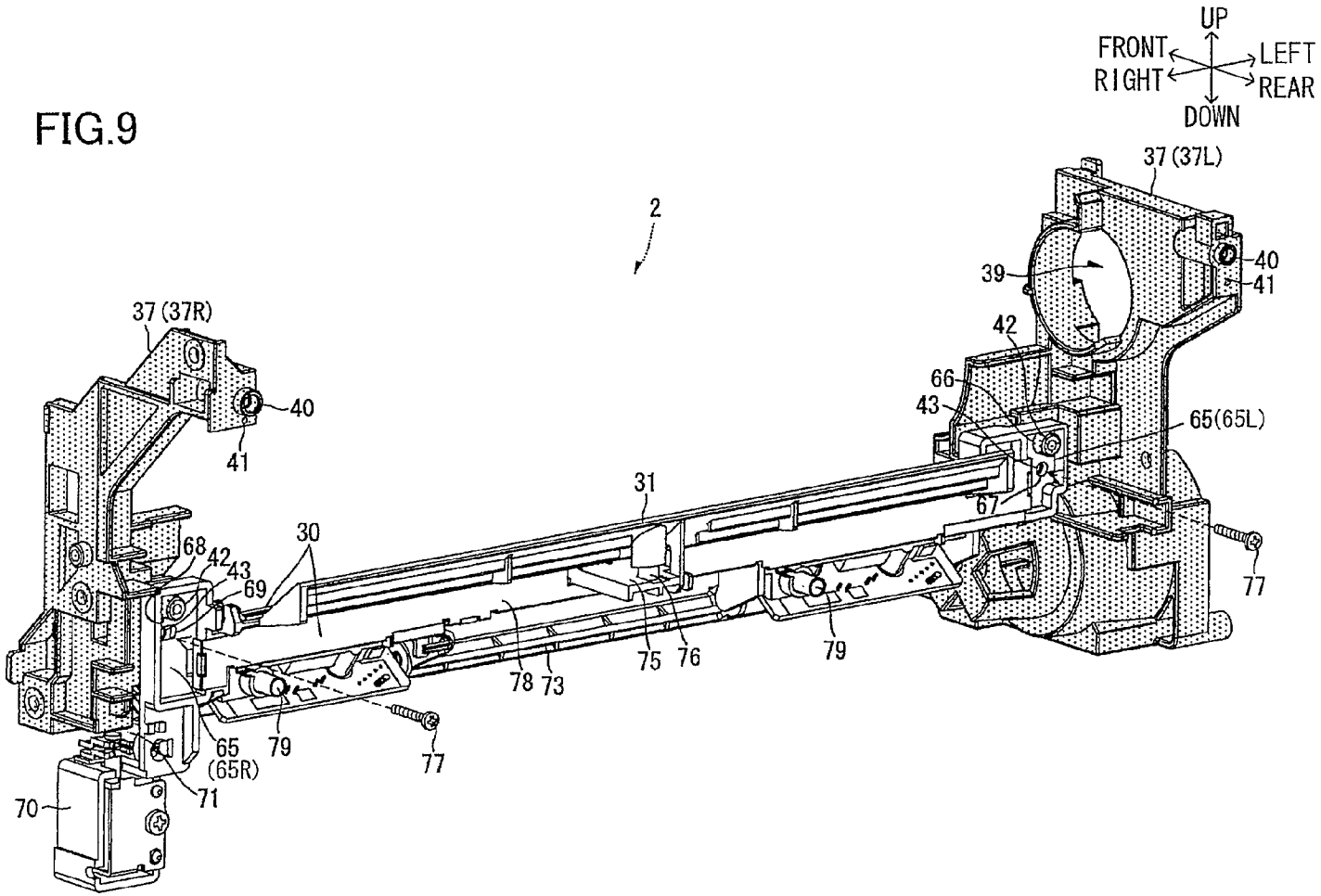
FIG. 9 is a perspective view of the first guide member attached to the mounting parts from a point diagonally rightward and rearward thereof.

The second guide part 31 is attached to the rear end of the first guide part 30, and the dimension of the second guide part 31 in the width direction is greater than the width of the sheet S. The second guide part 31 is pivotably supported at a front end to the first guide part 30 so that a rear end can move upward and downward, i.e., in a direction perpendicular to both the width direction of the sheet S and a sheet conveying direction in which the sheet S is conveyed. The rear end of the second guide part 31 is urged upward by a spring 76 (FIG. 9). The second guide part 31 extends diagonally upward and rearward from the rear end of the first guide part 30 toward the inlet 28 of the fixing casing 25.

From the upper portion 11A of the conveying belt 11, a sheet S conveyed rearward passes sequentially over the top surfaces of the first guide part 30 and the second guide part 31 and enters the inlet 28 of the fixing unit 13. Hence, the first guide part 30 and the second guide part 31 receive the sheet S conveyed by the sheet-conveying unit 23 and guide the sheet S to the fixing unit 13.

Normally, the fixing unit 13, and specifically the heat roller 26 and the pressure roller 27, is configured to convey the sheet S at a slower speed than the conveying belt 11 so that the fixing unit 13 positioned downstream from the conveying belt 11 in the sheet-conveying direction does not pull the sheet S from the conveying belt 11. The difference in the conveying speed of the fixing unit 13 and the conveying speed of the conveying belt 11 produces flexure in the sheet S between the conveying belt 11 and the fixing unit 13. To absorb this flexure, the second guide part 31 can pivot downward against the urging force of the spring 76, thereby preventing wrinkles from being formed in the sheet S guided by the second guide part 31 and preventing the sheet S from becoming jammed in the fixing unit 13 when the sheet S is transferred thereto.

As shown in FIG. 2, the main casing 2 includes a main frame 35. The main frame 35 includes a pair of metal side walls 36 arranged parallel to each other and separated in the width direction. In FIG. 2, the right side wall 36 is depicted with a dotted line.

Figure 3:
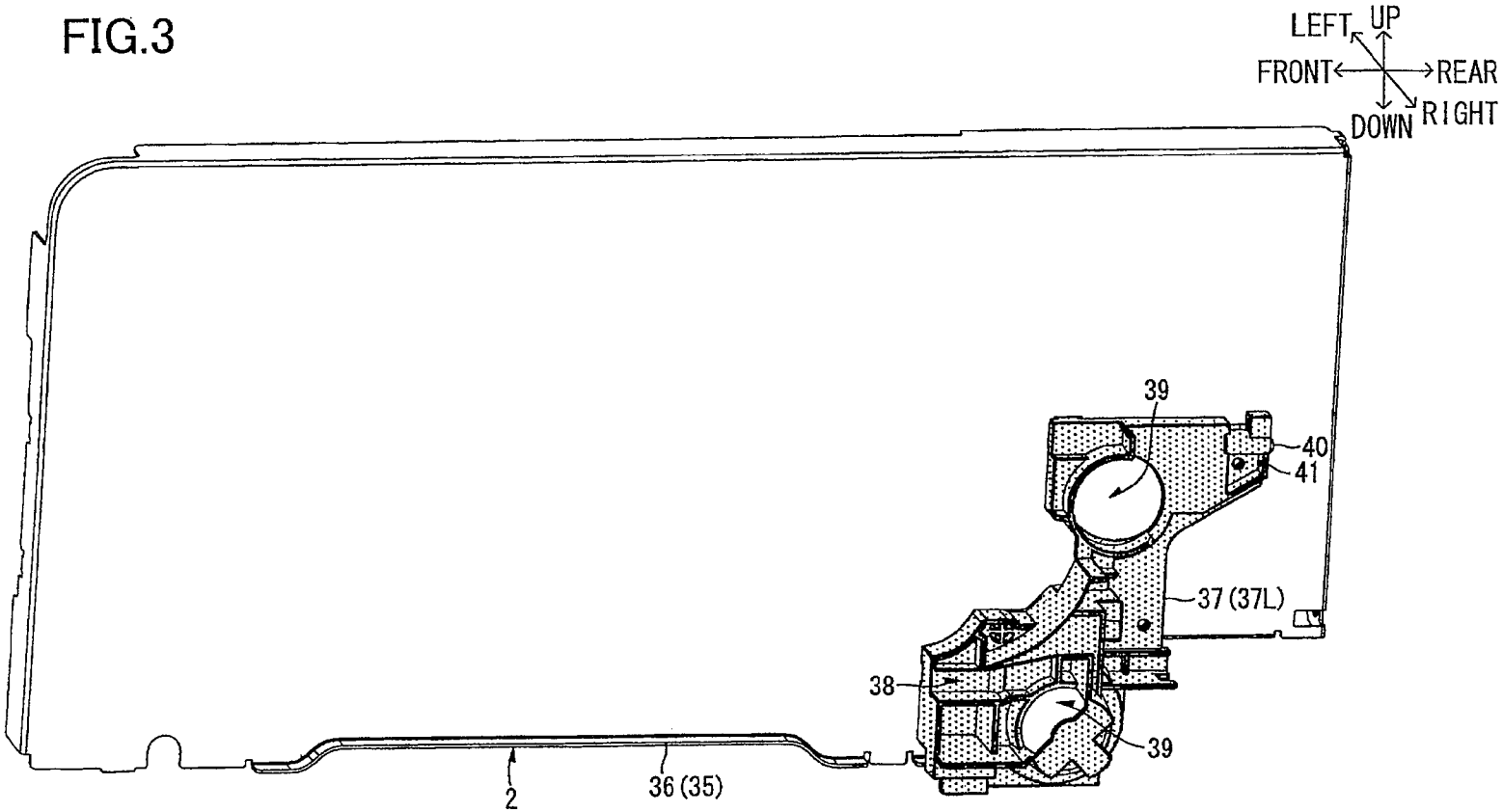
FIG. 3 is a perspective view of a left side wall of the main casing attached with one of mounting parts from a point diagonally rightward and frontward thereof.

As shown in FIG. 3, the side walls 36 have a rectangular plate shape with a thin width dimension and a surface aligned with the front-to-rear and vertical directions. The side walls 36 are formed by pressing metal plates with a prescribed die. In this embodiment, both the left and right side walls 36 are pressed using the same die.

A mounting part 37 is attached to the widthwise inner surface of each side wall 36. The mounting parts 37 are depicted with shading in FIGS. 2, 3, and other drawings. The mounting part 37 fixed to the right surface of the left side wall 36 in FIG. 3 is a left mounting part 37L, and the mounting part 37 fixed to the left surface of the right side wall 36 in FIG. 2 is a right mounting part 37R. Details of the mounting parts 37 will be described later.

More specifically, as shown in FIG. 2, the sheet-conveying unit 23, the fixing unit 13, the first guide part 30, and the second guide part 31 are disposed between the side walls 36. Hence, the left and right side walls 36 define the interior space of the main casing 2 in the width direction.

As shown in FIG. 2, the sheet-conveying unit 23 is disposed between the lower edges of the left and right side walls 36 and is elongated in the front-to-rear direction. The fixing unit 13 is disposed between the rear ends of the left and right side walls 36 and confronts the rear side of the sheet-conveying unit 23. The first guide part 30 and the second guide part 31 are disposed between the sheet-conveying unit 23 and the fixing unit 13, as described above, and extend between the left and right side walls 36.

The sheet-conveying unit 23 has rear end parts 23A. As will be described later, the left rear end part 23A and the left ends of the fixing unit 13 and the first guide part 30 are mounted in the left mounting part 37L on the left side wall 36, and the right rear end part 23A and the right ends of the fixing unit 13 and the first guide part 30 are mounted in the right mounting part 37R on the right side wall 36.

As shown in FIG. 2, the pair of right and left mounting parts 37R and 37L are disposed in the main casing 2 with a space therebetween in the width direction. The left mounting part 37L is attached to a rear section on the widthwise inner surface of the left side wall 36, and the right mounting part 37R is attached to a rear section on the widthwise inner surface of the right side wall 36, so that the right and left mounting parts 37R and 37L confront with each other in the width direction. That is, the right and left mounting parts 37R and 37L are disposed at substantially the same position with respect to both the vertical direction and the front-to-rear direction.

Although not shown in the drawings, each mounting part 37 is formed with a craw (not shown) and is fixed to the corresponding side wall 36 with the craw engaging with the side wall 36. Alternatively, the mounting part 37 may be fixed to the side wall 36 with a fixing member, such as a screw.

The mounting parts 37 are formed of a synthetic resin material. Because the side walls 36 of the main frame 35 are formed of metal, as described above, the side walls 36 have a higher rigidity than the mounting parts 37, even when the side walls 36 have been molded in the shape shown in FIG. 3. Hence, the main frame 35 can solidly support the mounting parts 37. Although the left and right mounting parts 37 are formed in a block shape that is slender in the left-to-right direction and elongated vertically, the shapes of the mounting parts 37 differ from each other in minor details.

Specifically, the left mounting part 37L when viewed from the right side, as shown in FIG. 3, is shaped substantially like the letter J. The front-to-rear dimension of the left mounting part 37L expands toward the rear from the approximate vertical center of the left mounting part 37L upward, and expands toward the front from the approximate vertical center downward. Two openings 39 penetrating the left mounting part 37L in the width direction are formed in the left mounting part 37L at positions aligned vertically. A gear or other inputting means (not shown) on the main casing 2 side for inputting a drive force into the fixing unit 13 is inserted into the top opening 39 along the width direction from the outer side thereof. Also, a gear or other inputting means (not shown) on the main casing 2 side for inputting a drive force into the sheet-conveying unit 23 is inserted into the bottom opening 39 along the width direction from the outer side thereof.

As shown in FIG. 2, the right mounting part 37R, on the other hand, extends upward from the bottom edge thereof in substantially a vertical direction, and then extends upward along a slope to the rear.

Figure 4:
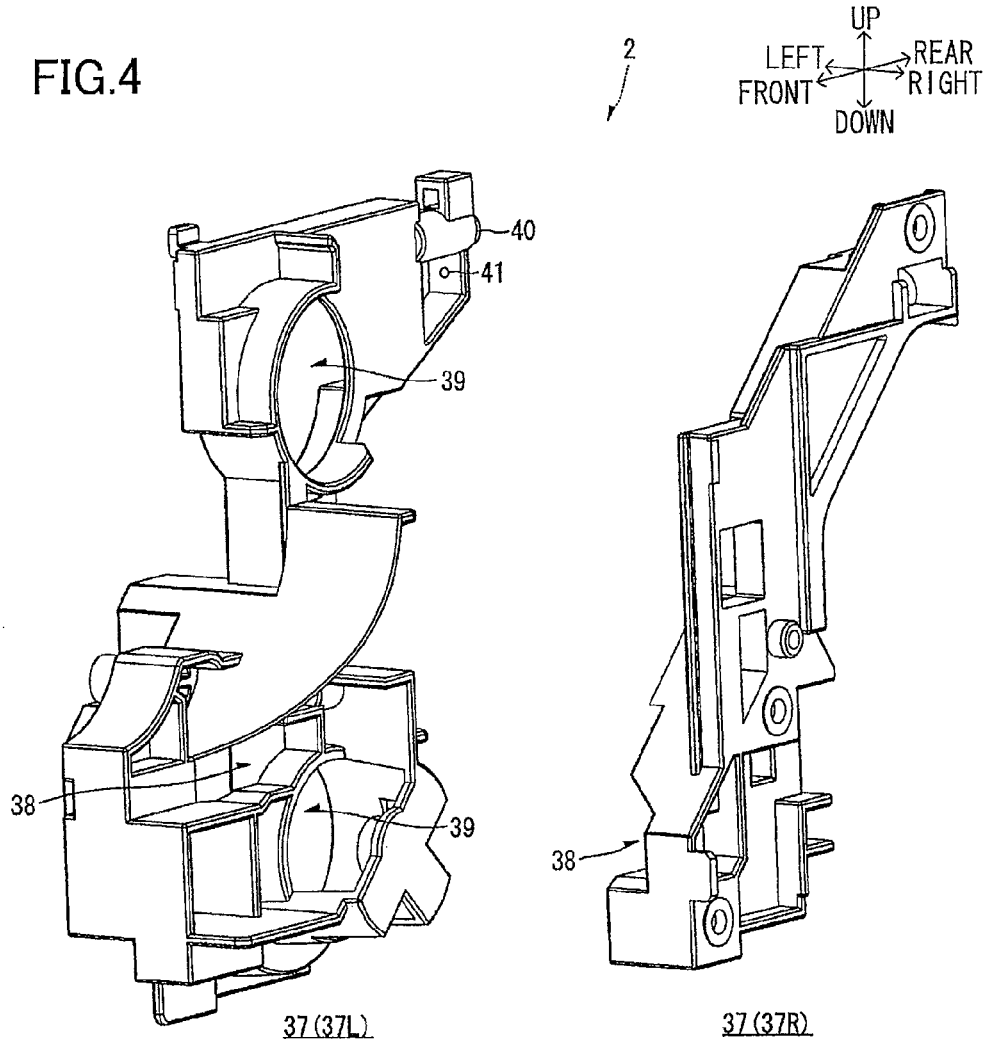
FIG. 4 is a perspective view of the mounting parts from a point diagonally frontward and rightward thereof.
Figure 5:
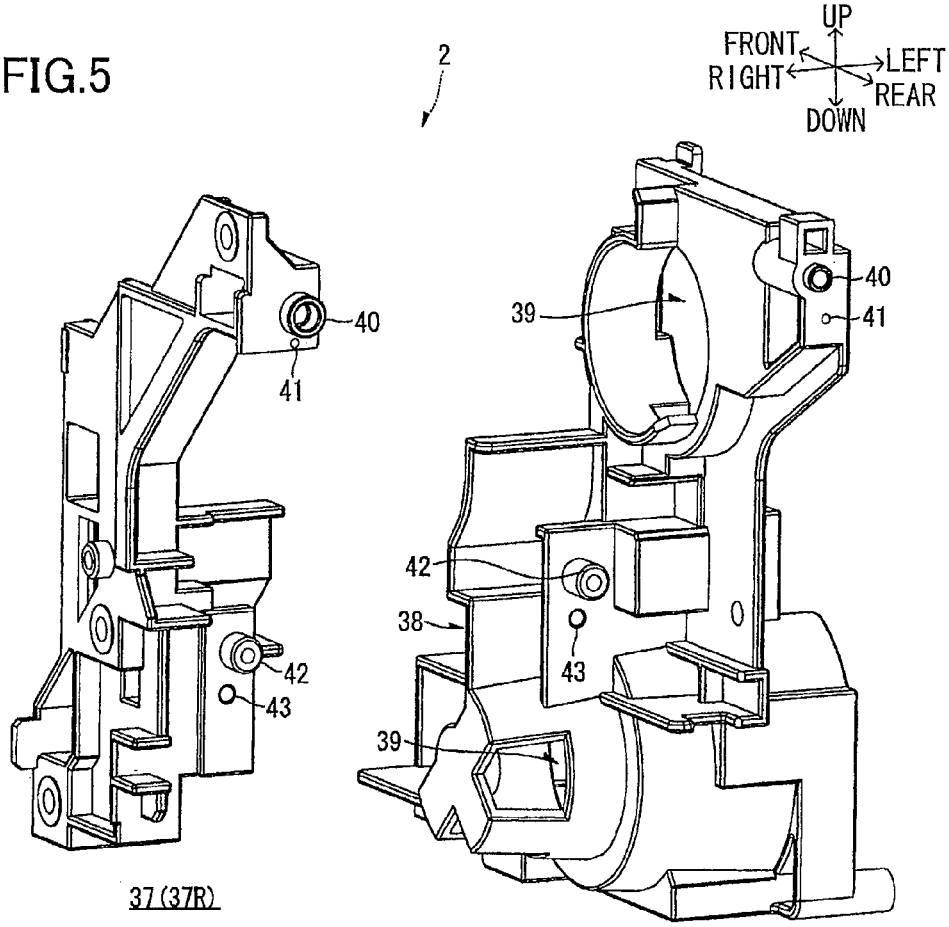
FIG. 5 is a perspective view of the mounting parts from a point diagonally rearward and rightward thereof.

As shown in FIGS. 4 and 5, a recessed part 38 is formed in the widthwise inner surface of each mounting part 37 (the right surface of the left mounting part 37L and the left surface of the right mounting part 37R) at substantially opposing positions in the lower ends thereof. The recessed parts 38 are groove-like cutout portions extending in the front-to-rear direction that are formed in the inner widthwise surfaces of the corresponding mounting parts 37 from the front edge to a midpoint in the front-to-rear direction. Hence, the front end of each recessed part 38 is open in the front endface of the corresponding mounting part 37 and exposed on the front side thereof.

As shown in FIG. 5, a first boss 40, a first threaded hole 41, a second boss 42, and a second threaded hole 43 are provided on the rear endface of each mounting part 37 in order from top to bottom. The vertical positions of the first boss 40, the first threaded hole 41, the second boss 42, and the second threaded hole 43 are approximately the same for both the left and right mounting parts 37.

More specifically, the first boss 40 is disposed on the top end of the rear endface of each mounting part 37, and the first threaded hole 41 is formed immediately below the first boss 40. The second boss 42 is disposed on the rear endface of each mounting part 37 in substantially the vertical center thereof or at a position slightly lower than the vertical center, and the second threaded hole 43 is formed immediately below the second boss 42. The first boss 40 and the second boss 42 are both cylindrically shaped and protrude rearward from the rear endface of the respective mounting part 37.

As described above, the sheet-conveying unit 23, the fixing unit 13, and the first guide part 30 are mounted in the mounting parts 37 attached to both left and right side walls 36 (see FIG. 2). Next, the manner in which the sheet-conveying unit 23, the fixing unit 13, and the first guide part 30 are mounted in the mounting parts 37 will be described in that order.

Figure 6:
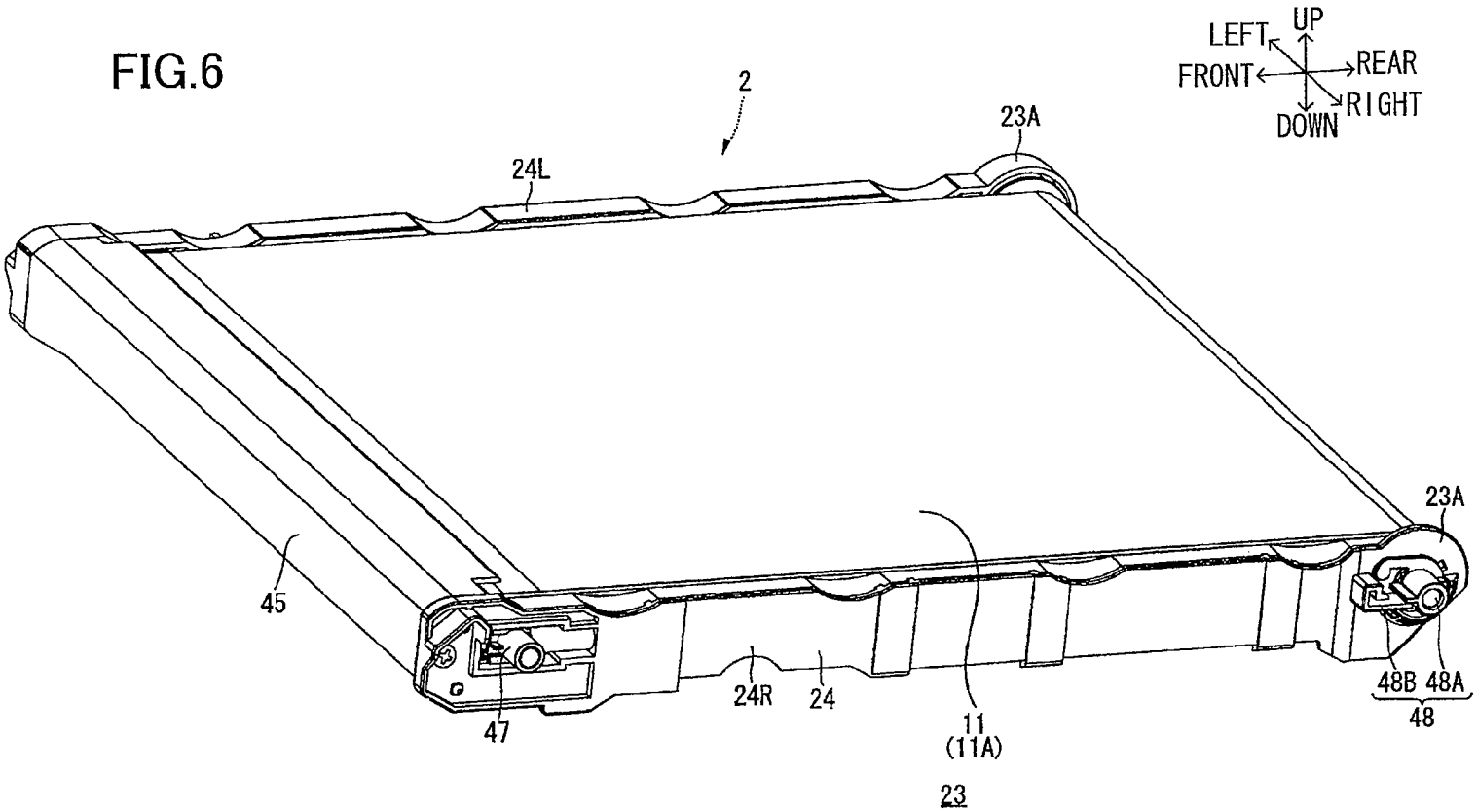
FIG. 6 is a perspective view of a sheet-conveying unit of the printer from a diagonally rightward and frontward thereof.

As shown in FIG. 6, the belt frame 24 of the sheet-conveying unit 23 is substantially plate-shaped, flattened vertically, and elongated in the front-to-rear direction. Most of the belt frame 24 is disposed inside the conveying belt 11. However, on the left and right sides, the belt frame 24 has side frame parts 24L and 24R spanning the entire length of the belt frame 24 in the front-to-rear direction and protruding outward from the conveying belt 11 in the width direction.

A grip part 45 spans between the front ends of the left and right side frame parts 24L and 24R. The grip part 45 is elongated in the width direction and is positioned in front of the conveying belt 11 to oppose the front end of the conveying belt 11, but is separated therefrom. An operator grips the grip part 45 when mounting the sheet-conveying unit 23 in the main casing 2 or removing the sheet-conveying unit 23 therefrom, as described above.

A front boss 47 and a rear boss 48 protrude outward in the width direction from each of the side frame parts 24L and 24R. The front bosses 47 are disposed on the front ends of the side frame parts 24L and 24R, while the rear bosses 48 are disposed on the rear ends thereof. The front bosses 47 are cylindrical in shape, for example. Each of the rear bosses 48 is integrally provided with a cylindrical body 48A, and a rib 48B connected to the front side of the cylindrical body 48A and slightly elongated in the front-to-rear direction. Overall, the rear boss 48 is elongated in the front-to-rear direction.

When the sheet-conveying unit 23 is mounted inside the main casing 2, as shown in FIG. 2, the left and right rear bosses 48 (FIG. 6) on the sheet-conveying unit 23 are fitted in a rearward direction into the recessed parts 38 (FIG. 4) of the mounting parts 37 on the same widthwise side. Through this operation, the rear bosses 48 are fixed to the corresponding mounting parts 37.

That is, as shown in FIG. 2, the rear end parts 23A of the sheet-conveying unit 23 (strictly speaking, the rear ends of the left and right side frame parts 24L and 24R) are mounted in the mounting parts 37, with the left end being mounted in the left mounting part 37L and the right end in the right mounting part 37R. In this way, the rear end parts 23A of the sheet-conveying unit 23 are mounted in the main casing 2 (the main frame 35) via the left and right mounting parts 37L and 37R. The front side of the sheet-conveying unit 23 is directly mounted on the left and right side walls 36 of the main frame 35. For example, support parts (not shown) are formed on the left and right side walls 36 protruding toward each other in opposing directions, and the front portions of the side frame parts 24L and 24R rest on and are supported by the support parts.

As shown in FIG. 2, levers 51 (only one lever 51 is shown in FIG. 2) are provided in the main casing 2. In this embodiment, the levers 51 are supported so as to be pivotable about their bottom ends. Springs 52 are provided in the main casing 2 for urging the levers 51 to pivot rearward. The upper portions of the levers 51 urged rearward by the springs 52 press the front bosses 47 of the sheet-conveying unit 23 rearward. Consequently, the entire sheet-conveying unit 23 is urged rearward so that the left and right rear bosses 48 on the sheet-conveying unit 23 are maintained in the corresponding recessed parts 38 formed in the mounting parts 37 (i.e., the recessed parts 38 on the same widthwise side).

Hence, after displacing the front wall 2A of the main casing 2 (see FIG. 1) to expose the interior of the main casing 2 on the front side thereof, the operator grips the grip part 45 of the belt frame 24 and pulls the sheet-conveying unit 23 in a forward direction. At this time, the front bosses 47 move forward and are disengaged from the levers 51, and the rear bosses 48 come out of the recessed parts 38. By removing the sheet-conveying unit 23 from the left and right mounting parts 37 (i.e., the main casing 2) in this way, it is possible to perform maintenance on or replace the sheet-conveying unit 23.

As shown in FIG. 2, the fixing unit 13 is mounted in the left and right mounting parts 37L and 37R from the rear side thereof and spans between the top edges of the left and right mounting parts 37L and 37R.

Figure 7:
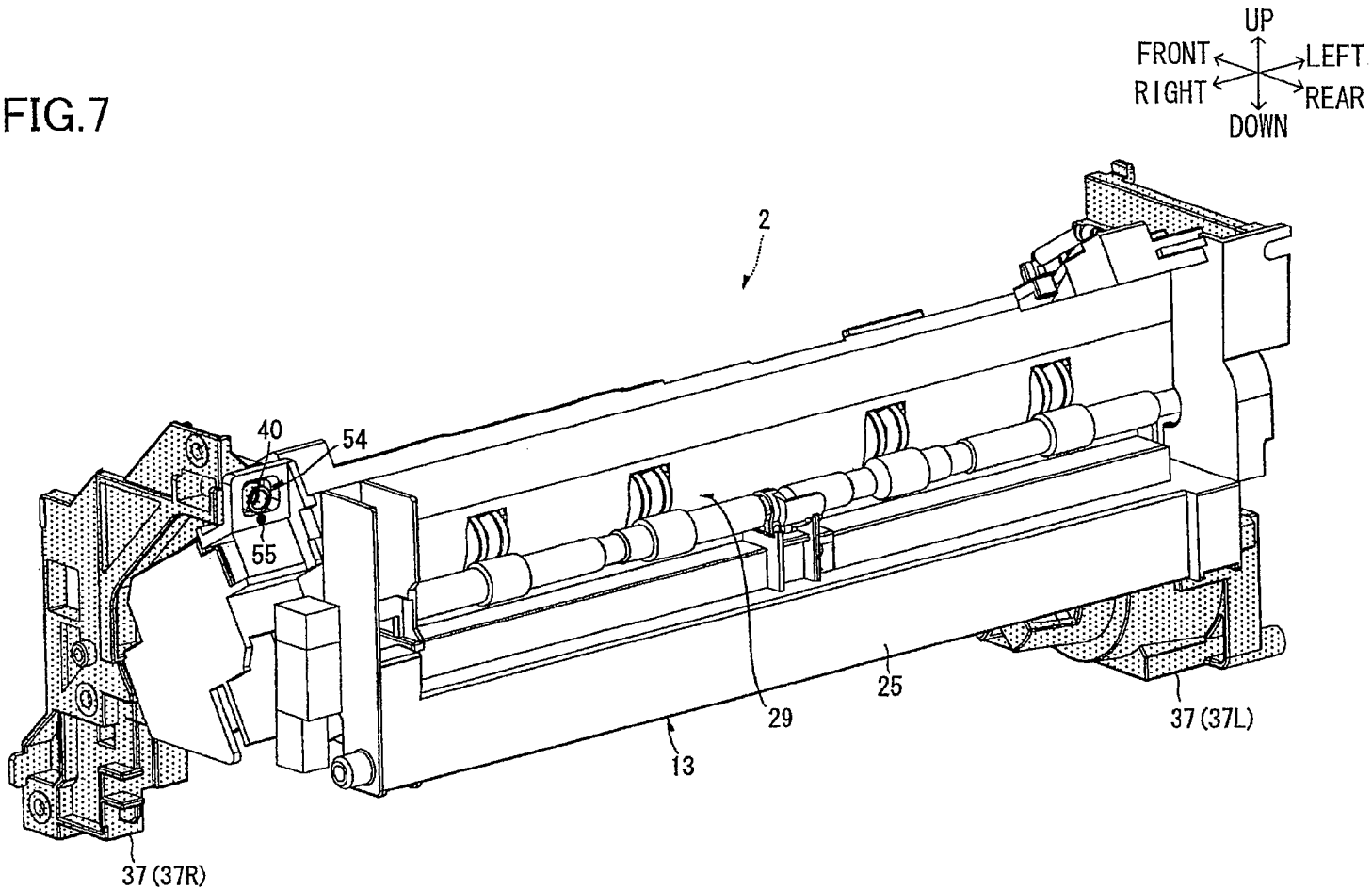
FIG. 7 is perspective view of a fixing unit supported in the mounting parts from a point diagonally rightward and rearward thereof.

More specifically, as shown in FIG. 7, a mounting hole 54 is formed one in both widthwise ends in the upper edge of the fixing case 25 of the fixing unit 13 (only the right mounting hole 54 is shown in FIG. 7). The fixing unit 13 is tentatively assembled on the left and right mounting parts 37L and 37R by mounting the fixing unit 13 so that the first bosses 40 formed on the mounting parts 37 are inserted through the mounting holes 54 on the same widthwise sides.

The mounting holes 54 are slightly elongated in the width direction so that the first bosses 40 can move slightly in the width direction when inserted into the mounting holes 54. Hence, the position of the fixing unit 13 in the width direction can be fine-tuned after the fixing unit 13 has been tentatively assembled on the left and right mounting parts 37L and 37R.

After the fixing unit 13 has been tentatively mounted on the left and right mounting parts 37L and 37R, screws 55 are inserted through the fixing case 25 from the rear side thereof in regions immediately below the corresponding mounting holes 54. The screws 55 are then screwed into the first threaded holes 41 (see FIG. 5) of the corresponding mounting parts 37 (i.e., the mounting parts 37 on the same widthwise sides) to fasten the fixing unit 13 to the mounting parts 37.

Through this operation, the fixing unit 13 is assembled and fastened to the left and right mounting parts 37L and 37R. That is, the left end of the fixing unit 13 is fastened to the left mounting part 37L and the right end to the right mounting part 37R. Hence, the fixing unit 13 is mounted on the main casing 2 (main frame 35) via the mounting parts 37.

To replace or conduct maintenance on the fixing unit 13, the operator displaces the rear wall 2B of the main casing 2 to expose the interior of the main casing 2 on the rear side, as described above. Next, the operator removes the screws 55 and pulls the fixing unit 13 rearward, at which time the first bosses 40 come out of the corresponding mounting holes 54 in the fixing unit 13. Consequently, the fixing unit 13 can be removed from the mounting parts 37 (and from the main casing 2) for maintenance or the like.

As shown in FIG. 8, the first guide part 30 is rectangular in shape and elongated in the width direction, as described above. The top surface of the first guide part 30 slopes slightly upward toward the rear side.

Fixing parts 65 (65L and 65R) are integrally provided on each widthwise end of the first guide part 30 for fixing the first guide part 30 to the corresponding left and right mounting parts 37L and 37R. The left and right fixing parts 65L and 65R are plate-shaped, with the thin dimension in the front-to-rear direction. The right fixing part 65R is particularly elongated vertically.

A first circular hole 66 and a second circular hole 67 are formed in the left fixing part 65L, with the first circular hole 66 positioned above the second circular hole 67. Both the first and second circular holes 66 and 67 are circular when viewed in the front-to-rear direction and penetrate the left fixing part 65L in the front-to-rear direction. The first circular hole 66 is larger than the second circular hole 67.

A first elongated hole 68 and a second elongated hole 69 are formed in the right fixing part 65R near the top end thereof, with the first elongated hole 68 positioned above the second elongated hole 69. Both the first and second elongated holes 68 and 69 are elongated in the width direction when viewed along the front-to-rear direction and penetrate the right fixing part 65R in the front-to-rear direction. The first elongated hole 68 is larger than the second elongated hole 69.

An actuator 70 is mounted on the lower end of the right fixing part 65R. The actuator 70 has a built-in solenoid (not shown) and a rotating member 71 disposed on the top thereof. The rotating member 71 can rotate about a shaft 72 extending in the front-to-rear direction. Specifically, the rotating member 71 rotates about the shaft 72 in a prescribed direction or in a direction opposite the prescribed direction, depending on whether the solenoid in the actuator 70 is excited or not excited.

A sensor 60 is provided one on each widthwise end of the first guide part 30. The sensors 60 are mounted on the front end of the bottom surface of the first guide part 30. The left and right sensors 60 confront the rear side of the sheet-conveying unit 23 (and specifically the outer surface of the conveying belt 11 on the rear end of the sheet-conveying unit 23; see FIG. 1).

The printer 1 has a check mode for confirming whether toner images are properly transferred onto a sheet S conveyed on the conveying belt 11 of the sheet-conveying unit 23. In the check mode, the printer 1 directly transfers toner images from the photosensitive drums 3 onto the conveying belt 11 of the sheet-conveying unit 23 and controls the sensors 60 to detect the toner images on the conveying belt 11. More specifically, a control unit (not shown) provided in the main casing 2 determines whether there are any irregularities in the densities of the toner images or any problems in registration among toner images of each color when the images are actually transferred onto a sheet S based on output from the sensors 60 when the sensors 60 detect the toner images. Based on the above determinations, the printer 1 can adjust variables in the image-forming process, such as the timing at which toner images are transferred onto the sheet S.

As shown in FIG. 8, a shutter 73 is provided on the front end of the first guide part 30. The shutter 73 is slightly longer in the width direction than the first guide part 30 (the portion of the first guide part 30 excluding the left and right fixing parts 65). The shutter 73 can move between open and closed positions on the front side of the left and right sensors 60 for respectively exposing or covering the sensors 60.

Specifically, the shutter 73 is rotatably supported on both widthwise ends by the first guide part 30 and can rotate about an axis extending in the width direction. A protrusion 74 is integrally provided on the right end of the shutter 73. The protrusion 74 protrudes rightward from the shutter 73 and contacts the rotating member 71 of the actuator 70 described above. With this construction, when the rotating member 71 rotates as described above, the rotating member 71 pushes against the protrusion 74, causing the shutter 73 to rotate.

When rotated diagonally downward and forward, as shown in FIG. 8, the shutter 73 is positioned below the left and right sensors 60. Consequently, the sensors 60 are exposed on the front side, and no objects are present between the sensors 60 and the sheet-conveying unit 23 (the outer surface of the conveying belt 11 on the rear end of the 23; see FIG. 1). At this time, the sensors 60 can detect toner images transferred onto the conveying belt 11 of the sheet-conveying unit 23 when the printer 1 is in the check mode described above.

However, when the shutter 73 is rotated upward from the state shown in FIG. 8, the shutter 73 covers and protects the sensors 60 from the front side thereof. Thus, the shutter 73 can prevent contaminants or the like from becoming deposited on the sensors 60 during an image-forming operation.

Plates 78 are provided in the first guide part 30, and specifically beneath the top surface of the first guide part 30, with one on either widthwise end. The plates 78 are electrically grounded via springs 79 (see FIG. 9) to eliminate static electricity from the first guide part 30.

As described above, the second guide part 31, which is rectangular and elongated in the width direction, is mounted on the rear edge of the first guide part 30 so that the second guide part 31 and the first guide part 30 form a single unit. The first guide part 30 supports the front edge of the second guide part 31 on both widthwise ends thereof (see also FIG. 9). Accordingly, the second guide part 31 can pivot freely about its front edge so that the rear edge moves vertically, as described above.

As shown in FIG. 9, a protruding part 75 is provided on the rear edge of the first guide part 30 at a position in the widthwise center thereof. The protruding part 75 protrudes rearward below the second guide part 31. The spring 76 is disposed on the top surface of the protruding part 75 and extends upward therefrom. The spring 76 pushes upward against a rear edge portion of the second guide part 31, urging the rear edge of the second guide part 31 to pivot upward about its front edge.

The first guide part 30 having this construction is mounted on the left and right mounting parts 37L and 37R from the rear side thereof and spans between the lower ends of the mounting parts 37.

Specifically, the first guide part 30 is mounted on the mounting parts 37 so that the second boss 42 of the left mounting part 37L is inserted rearward through the first circular hole 66 formed in the left fixing part 65L of the first guide part 30, and the second boss 42 of the right mounting part 37R is inserted rearward through the first elongated hole 68 formed in the right fixing part 65R of the first guide part 30. When inserted into the first elongated hole 68, the second boss 42 on the right mounting part 37R can move slightly in the longitudinal direction of the first elongated hole 68 (the width direction). Hence, the second bosses 42 on both the left and right mounting parts 37L and 37R can be inserted through the corresponding first circular hole 66 and first elongated hole 68, even when there is a small error in the gap between the left and right second bosses 42 (i.e., the gap between the left and right mounting parts 37L and 37R).

In this way, the first guide part 30 is tentatively mounted on the left and right mounting parts 37L and 37R. At this time, the second circular hole 67 on the left fixing part 65L is aligned with the second threaded hole 43 formed in the left mounting part 37L from the rear side thereof, while the second elongated hole 69 formed in the right fixing part 65R is aligned with the second threaded hole 43 formed in the right mounting part 37R from the rear side thereof. Next, a screw 77 is inserted in a forward direction through the second circular hole 67 formed in the left fixing part 65L and screwed into the second threaded hole 43 formed in the left mounting part 37L, and another screw 77 is inserted in a forward direction through the second elongated hole 69 formed in the right fixing part 65R and screwed into the second threaded hole 43 formed in the right mounting part 37R.

This operation completes the process for mounting the first guide part 30 on the left and right mounting parts 37L and 37R. In other words, the left end (left fixing part 65L) of the first guide part 30 is mounted on the left mounting part 37L, and the right end (right fixing part 65R) is mounted on the right mounting part 37R. Accordingly, the first guide part 30 is mounted on the main casing 2 (main frame 35) via the left and right mounting parts 37L and 37R (see FIG. 2).

To remove the first guide part 30 from the main casing 2, the operator displaces the rear wall 2B on the main casing 2 (see FIG. 1) to expose the interior of the main casing 2 on the rear side thereof, and subsequently removes the screws 77 and pulls the first guide part 30 rearward. At this time, the second boss 42 of the left mounting part 37L is disengaged from the first circular hole 66 of the left fixing part 65L of the first guide part 30, and the second boss 42 of the right mounting part 37R is disengaged from the first elongated hole 68 of the right fixing part 65R of the first guide part 30. By disengaging the second bosses 42 from the holes 66 and 68 in this way, it is possible to detach the first guide part 30 from the mounting parts 37, i.e., from the main casing 2. Thus, it is possible to perform maintenance on the first guide part 30 and the second guide part 31.

Alternatively, the fixing unit 13 and the first guide part 30 may be premounted on the left and right mounting parts 37L and 37R. In this state, the mounting parts 37 may be mounted in the main frame 35, as shown in FIG. 2. Thereafter, the sheet-conveying unit 23 may be mounted in the recessed parts 38 of the mounting parts 37 and supported on the support parts (not shown) of the side walls 36. In order to perform maintenance or the like, the fixing unit 13 and the first guide part 30 are removed together with the mounting parts 37 from the main frame 35.

In the printer 1 having the above construction, the mounting parts 37 are mounted in the main frame 35 of the main casing 2, and the rear end parts 23A of the sheet-conveying unit 23 and the ends of the fixing unit 13 and the first guide part 30 are all mounted in the same mounting parts 37 on the same widthwise sides. This configuration assures that the sheet-conveying unit 23 (specifically, the rear end parts 23A), the fixing unit 13, and the first guide part 30 can be positioned relative to each other with greater precision than when these components are mounted in separate mounting parts.

Hence, the present invention improves the precision in positioning the fixing unit 13 and the first guide part 30 relative to the sheet-conveying unit 23, which functions to convey sheets S. Any offset that occurs in the relative positions of the fixing unit 13 and the first guide part 30 based on the sheet-conveying unit 23 reduces the precision in which the sheet-conveying unit 23, the fixing unit 13, and the first guide part 30 convey the sheets S. This reduction in precision may lead to sheets S passing through the nip position N between the heat roller 26 and the pressure roller 27 in an improper state, for example, producing wrinkles in the sheet S or creating other problems.

However, the structure of the above-described embodiment improves the precision of positioning the fixing unit 13 and the first guide part 30 based on the sheet-conveying unit 23. Hence, the first guide part 30 (including the second guide part 31) can guide the sheets S conveyed by the sheet-conveying unit 23 to the fixing unit 13 with great precision, enabling the fixing unit 13 to fix toner images on sheets S conveyed therethrough with great precision.

Because at least the rear end parts 23A of the sheet-conveying unit 23 (parts of the sheet-conveying unit 23 adjacent to the fixing unit 13 and the first guide part 30) are mounted on the same mounting parts 37 as the fixing unit 13 and the first guide part 30 in the above-described embodiment, the sheet-conveying unit 23 can convey sheets S to the fixing unit 13 with great precision.

As described above, the mounting parts 37 position all of the components that function to perform all operations from conveyance of the sheet S after toner images are transferred thereto to fixing of the toner images on the sheet S (i.e., the sheet-conveying unit 23, the fixing unit 13, and the first guide part 30).

Because this construction improves the precision in relative positioning of the sheet-conveying unit 23 and the first guide part 30, the relative positioning of the sensors 60 mounted on the first guide part 30 to the sheet-conveying unit 23 is also improved (see FIG. 1). Accordingly, the sensors 60 can detect toner images transferred onto the conveying belt 11 with greater precision.

Further, forming both side walls 36 using the same die to press the plates can equalize the error when molding each side wall 36, thereby reducing error in mounting the mounting parts 37 on the side walls 36. Accordingly, this method reduces the error in mounting the sheet-conveying unit 23, the fixing unit 13, and the first guide part 30 on the mounting parts 37 for both widthwise sides thereof. As a result, the present invention improves the precision in fixing the relative positions of the sheet-conveying unit 23, the fixing unit 13, and the first guide part 30 across the entire width thereof.

Further, by forming the mounting parts 37 of a synthetic resin material, the mounting parts 37 can easily be shaped to facilitate mounting of the sheet-conveying unit 23, the fixing unit 13, and the first guide part 30.

Further, mounting each widthwise end of the sheet-conveying unit 23, the fixing unit 13, and the first guide part 30 in a mounting part 37 provided on the same widthwise side improves the precision is positioning the sheet-conveying unit 23, the fixing unit 13, and the first guide part 30 relative to one another across the entire width thereof.

While the invention has been described in detail with reference to the embodiment thereof, it would be apparent to those skilled in the art that various changes and modifications may be made therein without departing from the spirit of the invention.

For example, in the above-described embodiment, each widthwise end of the sheet-conveying unit 23, the fixing unit 13, and the first guide part 30 is mounted in a mounting part 37 disposed on the same widthwise side. However, it is possible to mount only one widthwise end of each of the sheet-conveying unit 23, the fixing unit 13, and the first guide part 30 in a mounting part 37 disposed on the same widthwise side thereof. In this case, the left ends of the sheet-conveying unit 23, the fixing unit 13, and the first guide part 30 can be mounted in the left mounting part 37L, for example, while the right ends of the same components are directly mounted in the main frame 35 (i.e., the right side wall 36).

Further, while the second guide part 31 is provided on the first guide part 30 in the above-described embodiment, the second guide part 31 may be provided on the fixing unit 13 (the fixing case 25) instead of the first guide part 30.

What is claimed is:

1. An image forming device comprising:

a main body having a main frame;

a plurality of photosensitive members arrayed in the main body;

a conveying unit disposed in the main body so as to confront the plurality of photosensitive members, the conveying unit conveying a recording medium with images transferred from the photosensitive members;

a fixing unit disposed in the main body, the fixing unit receiving the recording medium conveyed by the conveying unit and fixing the images onto the recording medium; and an attaching member that is attached to the main frame and attaches both the fixing unit and an end section of the conveying unit nearest the fixing unit to the main frame, wherein the attaching member attaches the conveying unit only at the end section of the conveying unit.

2. The image forming device according to claim 1, further comprising a first guide disposed between the conveying unit and the fixing unit, the first guide guiding the recording medium from the conveying unit toward the fixing unit, wherein the attaching member attaches the first guide to the main frame.

3. The image forming device according to claim 2, further comprising a sensor provided on the first guide so as to confront the conveying unit, the sensor detecting images transferred from the photosensitive members onto the conveying unit.

4. The image forming device according to claim 2, further comprising a second guide attached to the first guide so as to be pivotable in a direction substantially perpendicular to both a conveying direction in which the recording medium is conveyed and a width direction of the recording medium.

5. The image forming device according to claim 2, wherein:

the main frame has a pair of side walls in confrontation with each other and spaced apart in a predetermined direction perpendicular to a conveying direction in which the recording medium is conveyed;

the attaching member includes a pair of attachment members attached to the respective side walls;

one of the attachment members attaches one end of each of the end section of the conveying unit, the fixing unit, and the first guide in the predetermined direction to one of the side walls; and the other of the attachment members attaches the other end of each of the end section of the conveying unit, the fixing unit, and the first guide in the predetermined direction to the other of the side walls.

6. The image forming device according to claim 5, wherein the side walls are formed by pressing plates with the same die.

7. The image forming device according to claim 1, wherein the main frame is made of material having a higher rigidity than the attaching member.

8. The image forming device according to claim 7, wherein the main frame is made of metal, and the attaching member is made of resin.

9. An image forming device comprising:

a main body having a main frame;

a plurality of photosensitive members arrayed in the main body;

a conveying unit disposed in the main body so as to confront the plurality of photosensitive members, the conveying unit conveying a recording medium with images transferred from the photosensitive members;

a fixing unit disposed in the main body, the fixing unit receiving the recording medium conveyed by the conveying unit and fixing the images onto the recording medium;

a first guide disposed between the conveying unit and the fixing unit, the first guide guiding the recording medium from the conveying unit toward the fixing unit; and an attaching member that is attached to the main frame and attaches both the first guide and an end section of the conveying unit nearest the fixing unit to the main frame, wherein the attaching member attaches the conveying unit only at the end section of the conveying unit.

10. The image forming device according to claim 9, further comprising a second guide attached to the first guide so as to be pivotable in a direction substantially perpendicular to both a conveying direction in which the recording medium is conveyed and a width direction of the recording medium.

11. The image forming device according to claim 9, wherein:

the main frame has a pair of side walls in confrontation with each other and spaced apart in a predetermined direction perpendicular to a conveying direction in which the recording medium is conveyed;

the attaching member includes a pair of attachment members attached to the respective side walls;

one of the attachment members attaches one end of each of the end section of the conveying unit and the first guide in the predetermined direction to one of the side walls; and the other of the attachment members attaches the other end of each of the end section of the conveying unit and the first guide in the predetermined direction to the other of the side walls.

* * * * *